US006972649B1

(12) United States Patent
Murthy et al.

(10) Patent No.: US 6,972,649 B1
(45) Date of Patent: Dec. 6, 2005

(54) METHOD AND APPARATUS FOR SHIELDING AND ARMATURE FROM A MAGNETIC FLUX

(75) Inventors: Venkatesh Murthy, Bangalore (IN); Joseph Kelaita, Jr., Bristol, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/905,500

(22) Filed: Jan. 7, 2005

(51) Int. Cl.[7] ..... H01H 75/10
(52) U.S. Cl. ..... 335/42; 335/35; 335/23; 335/176
(58) Field of Search ..... 335/6, 8–10, 23–25, 335/35–42, 165–176

(56) References Cited

U.S. PATENT DOCUMENTS 4,725,800 A * 2/1988 Grunert et al. ..... 335/38
5,005,104 A * 4/1991 Grunert et al. ..... 361/637
5,894,259 A * 4/1999 Kolberg et al. ..... 337/333
6,750,743 B1 6/2004 Subramanian ..... 335/8
2001/0000955 A1 * 5/2001 Leone et al. ..... 335/35

* cited by examiner

*Primary Examiner*—Lincoln Donovan
(74) *Attorney, Agent, or Firm*—Cantor Colburn LLP

(57) ABSTRACT

A trip unit for a circuit breaker having a current carrying conductor that electrically communicates with a cable or a bus bar. The trip unit includes a current carrying strap, a magnet core, an armature and a magnetic barrier. The current carrying strap is adapted to be in electrical communication with the current carrying conductor. The magnet core is disposed at the current carrying strap. The armature is pivotally disposed in magnetic communication with the magnet core. The magnetic barrier is disposed to shield the armature from a magnetic flux generated in the current carrying conductor.

20 Claims, 10 Drawing Sheets

METHOD AND APPARATUS FOR SHIELDING AND ARMATURE FROM A MAGNETIC FLUX

BACKGROUND OF THE INVENTION

The present invention relates to circuit breakers and, more particularly, to circuit breakers including thermal and magnetic trip units.

Circuit breakers typically provide instantaneous, short time, and long-time protection against high currents produced by various conditions such as short-circuits, ground faults, overloads, etc. In a circuit breaker, a trip unit is a device that senses a current (or other electrical condition) in a protected circuit and responds to a high current condition by tripping (unlatching) the circuit breaker's operating mechanism. Tripping the operating mechanism in turn separates the circuit breaker's main current-carrying contacts to stop the flow of electrical current to the protected circuit. Such trip units are required to meet certain standards, for example, UL/ANSI/IEC, which define trip time curves specifying under what conditions a trip must occur, such as, for example, short time, long time, instantaneous, or ground fault.

One type of trip unit is known as a thermal and magnetic trip unit. A thermal and magnetic trip unit includes a magnetic assembly and a thermal assembly. The thermal assembly typically includes a bimetallic element through which electrical current flows. As current flows through the bimetallic element, the bimetallic element heats up and bends due to the different coefficients of expansion in the metals used to form the bimetallic element. If the temperature rise is sufficient, the bimetallic element bends enough to move an associated trip latch, which unlatches the operating mechanism to separate the main current-carrying contacts. The thermal assembly is typically used to sense an overload condition.

The magnetic assembly typically includes a magnet core (yoke) disposed about a current carrying strap, an armature (lever) pivotally disposed near the core, and a spring arranged to bias the armature away from the magnet core. Upon the occurrence of a short circuit condition, a very high current passes through the strap. The increased current causes an increase in the magnetic field around the magnet core. The magnetic field acts to rapidly draw the armature toward the magnet core, against the bias of the spring. As the armature moves toward the core, the end of the armature moves an associated trip latch, which unlatches the operating mechanism causing the main current-carrying contacts to separate or open.

The thermal and magnetic trip unit has a load terminal, which provides a means for connection of the mechanism for the thermal and magnetic trip unit to an electrical load. It is common for users of a thermal and magnetic trip unit to configure the load terminal to connect to either a bus bar or to a lug and cable. Conversion between configurations is optionally performed depending on the type of application in which the thermal and magnetic trip unit is used.

As circuit breakers of all types including those with thermal and magnetic trip units are evolving, there is a desire to achieve compact designs. Thus, it is desirable to design components that enable a compact and efficiently operating circuit breaker.

BRIEF DESCRIPTION OF THE INVENTION

Exemplary embodiments of the invention include a trip unit for a circuit breaker having a current carrying conductor that electrically communicates with a cable or a bus bar. The trip unit includes a current carrying strap, a magnet core, an armature and a magnetic barrier. The current carrying strap is adapted to be in electrical communication with the current carrying conductor. The magnet core is disposed at the current carrying strap. The armature is pivotally disposed in magnetic communication with the magnet core. The magnetic barrier is disposed to shield the armature from a magnetic flux generated in the current carrying conductor.

Further exemplary embodiments of the invention include a cassette for a circuit breaker having a current carrying conductor that electrically communicates with a cable or a bus bar. The cassette includes a housing, a trip bar rotatably disposed at the housing, and a trip unit in mechanical communication with the trip bar. The trip unit includes a current carrying strap, a magnet core, an armature and a magnetic barrier. The current carrying strap is adapted to be in electrical communication with the current carrying conductor. The magnet core is disposed at the current carrying strap. The armature is pivotally disposed in magnetic communication with the magnet core. The magnetic barrier is disposed to shield the armature from a magnetic flux generated in the current carrying conductor.

Still further exemplary embodiments of the invention include The cassette includes a housing, a trip bar rotatably disposed at the housing, and a trip unit in mechanical communication with the trip bar. The trip unit includes a current carrying strap, a magnet core, an armature and a magnetic barrier. The current carrying strap is adapted to be in electrical communication with the current carrying conductor. The magnet core is disposed at the current carrying strap. The armature is pivotally disposed in magnetic communication with the magnet core. The magnetic barrier is disposed to shield the armature from a magnetic flux generated in the current carrying conductor.

Yet another exemplary embodiment of the invention includes a circuit breaker having a current carrying conductor that electrically communicates with a cable or a bus bar. The circuit breaker includes a main contact assembly, a mechanism for operating the main contact assembly, and a cassette in operable communication with the mechanism. The cassette includes a housing, a trip bar rotatably disposed at the housing, and a trip unit in mechanical communication with the trip bar. The trip unit includes a current carrying strap, a magnet core, an armature and a magnetic barrier. The current carrying strap is adapted to be in electrical communication with the current carrying conductor. The magnet core is disposed at the current carrying strap. The armature is pivotally disposed in magnetic communication with the magnet core. The magnetic barrier is disposed to shield the armature from a magnetic flux generated in the current carrying conductor.

Another exemplary embodiment of the invention includes a method for shielding an armature of a trip unit from a magnetic flux. The trip unit has a current carrying conductor and a current carrying strap electrically coupled with the current carrying conductor. The magnetic flux is produced by a current through the current carrying conductor. The method includes disposing a magnetic barrier proximate to an armature and redirecting the magnetic flux in response to the presence of the magnetic flux.

The above, and other objects, features and advantages of the present invention will become apparent from the following description read in conjunction with the accompanying drawings, in which like reference numerals designate the same elements.

BRIEF DESCRIPTION OF THE DRAWINGS

Referring now to the drawings wherein like elements are numbered alike in the several FIGURES.

DETAILED DESCRIPTION OF THE INVENTION

Figure 1:
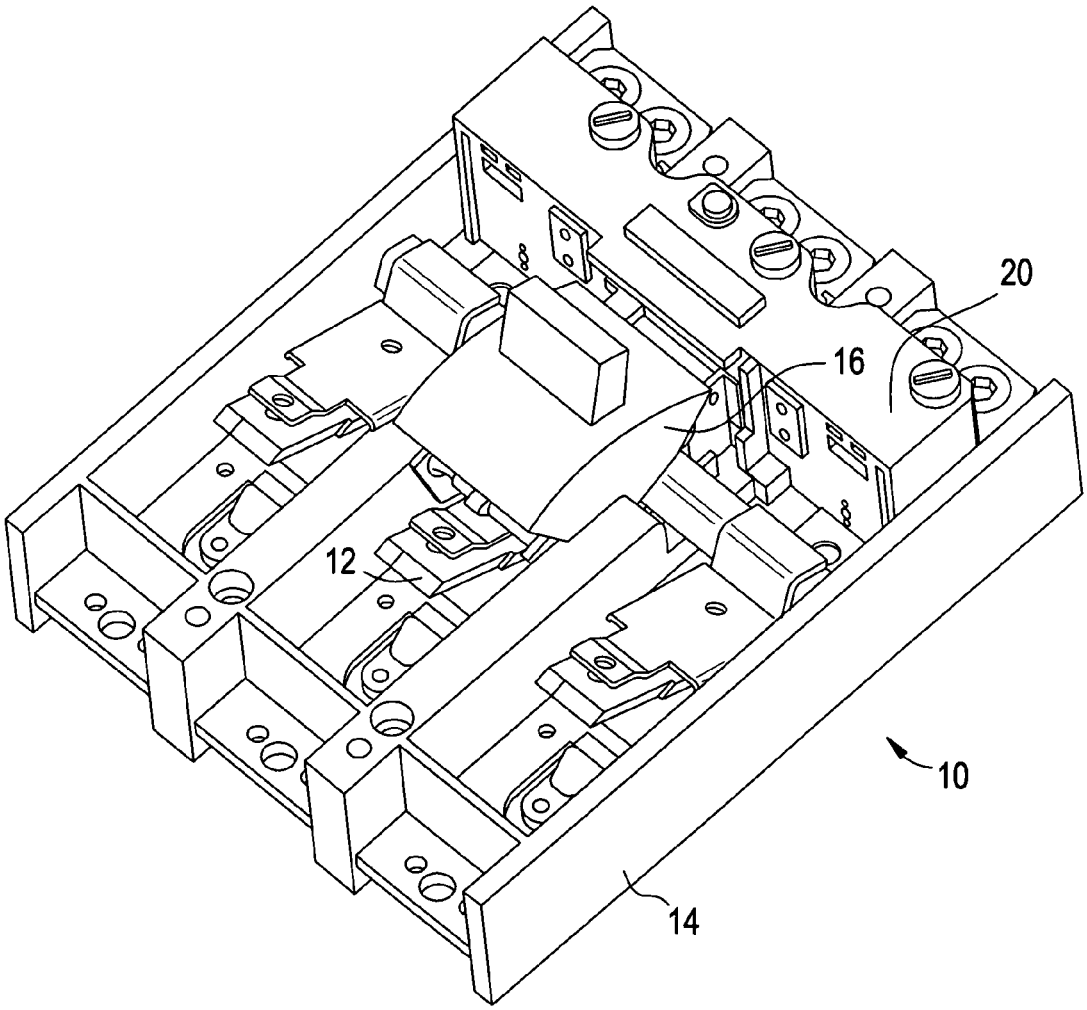
FIG. 1 is a perspective view of a circuit breaker according to an exemplary embodiment.
Figure 2:
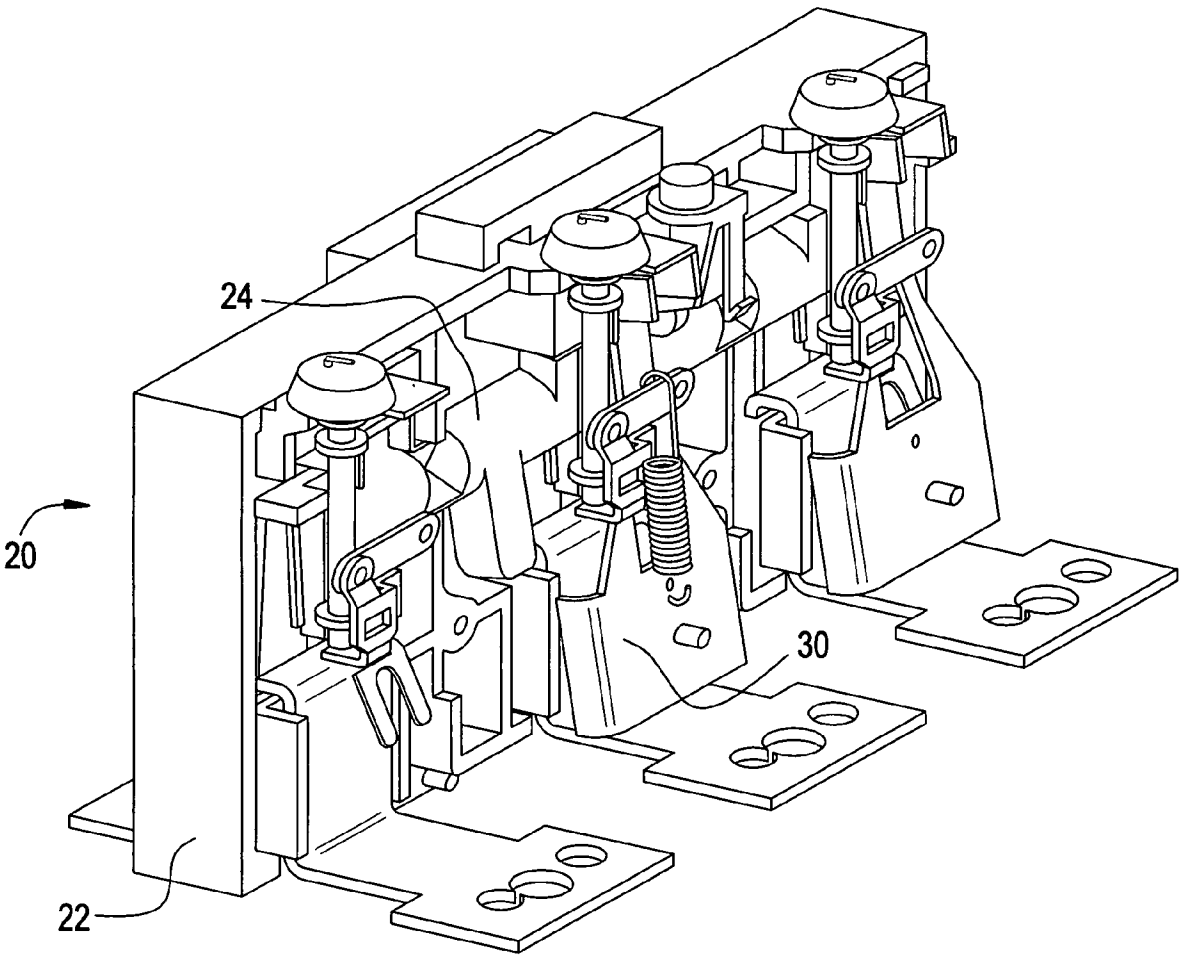
FIG. 2 is a perspective view of a cut away of a cassette according to an exemplary embodiment.

FIG. 1 shows an exemplary embodiment in which a circuit breaker 10 includes a main current-carrying contacts 12, a case 14, an operating mechanism 16 (see also FIGS. 6 and 7), and a cassette 20. FIG. 2 is cut away view of the cassette 20. Cassette 20 includes a housing 22, a trip bar 24, and a thermal and magnetic trip unit 30.

Figure 3:
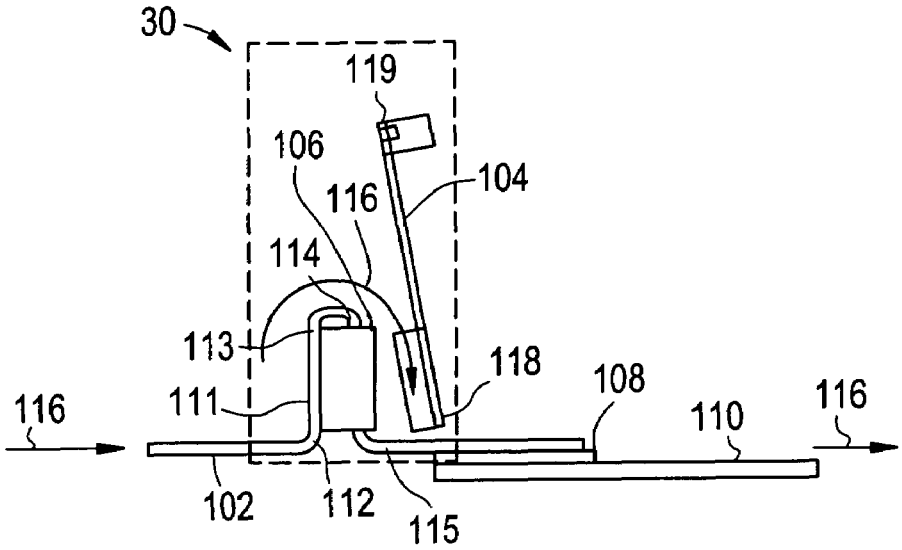
FIG. 3 is a schematic view of a thermal and magnetic trip unit with a load terminal connected to a bus bar according to an exemplary embodiment.
Figure 5:
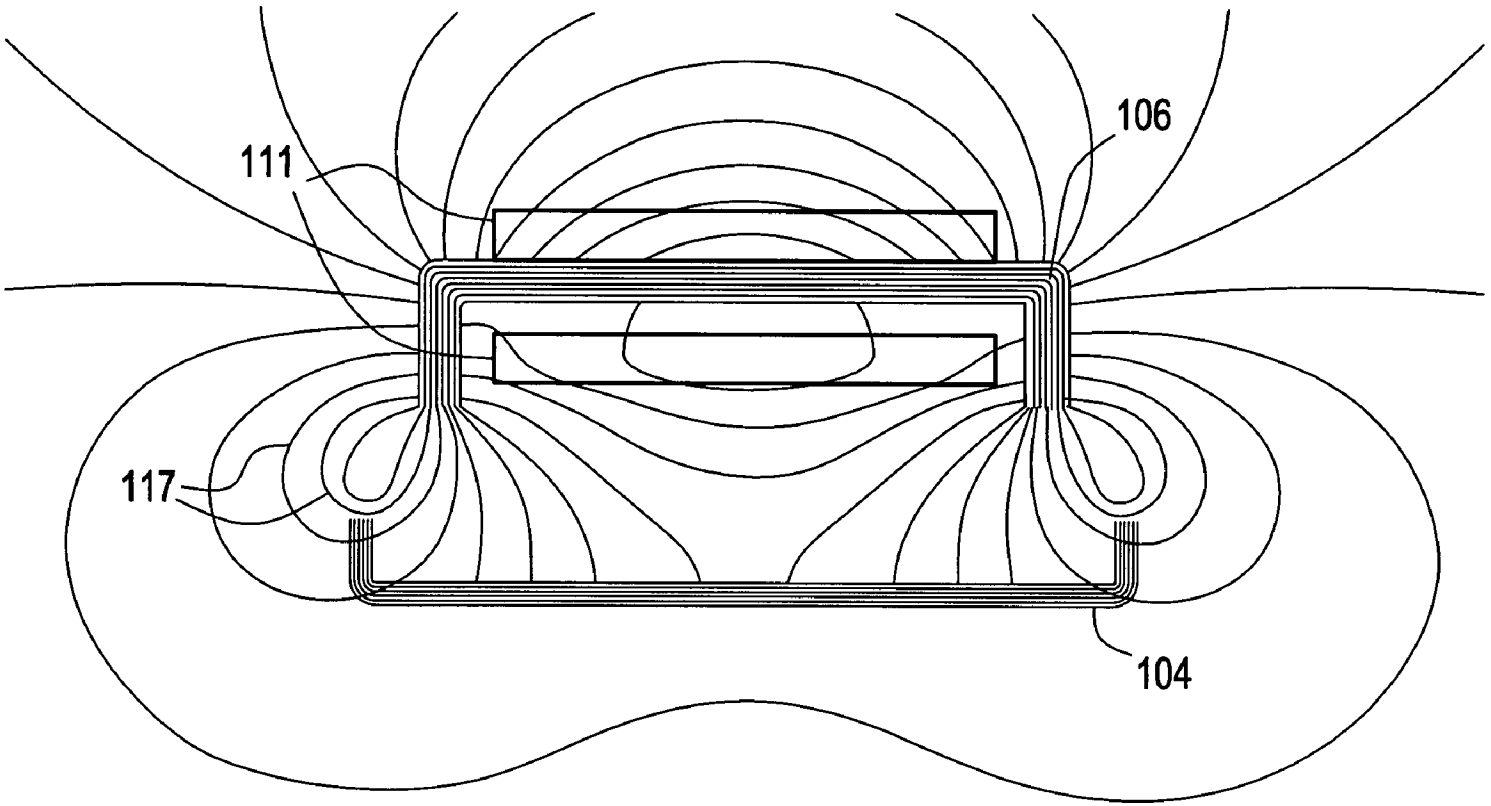
FIG. 5 shows magnetic lines of flux created when current passes through the thermal and magnetic trip unit of FIG. 4.

FIG. 3 shows an exemplary embodiment in which a thermal and magnetic trip unit 30 is configured without a shunt 100 (see FIG. 5). In FIG. 3, the thermal and magnetic trip unit 30 comprises a plurality of components. The plurality of components includes a thermal element 102, an armature 104, a magnet core 106, and a load terminal 108 connected to a bus bar 110. The bus bar 110 carries electrical current from input terminal 107 to an electrical load (not shown), which may be downstream of the thermal and magnetic trip unit 30 when the main current-carrying contacts 12 are closed.

Thermal element 102 includes a bent section to facilitate receiving the magnet core 106. The bent section forms a strap 111. The strap 111 is a conductor, which passes through the magnet core 106. The strap 111 includes a first bend 112 of the conductor to a second direction, which is substantially perpendicular to the first direction, followed by a second bend 113 of the conductor back to the first direction. The strap 111 further includes a third bend 114 of the conductor to a third direction followed by a fourth bend 115 of the conductor back to the first direction. The third direction is substantially opposite to the second direction and substantially perpendicular to the first direction. It will be appreciated by one skilled in the art that, in an exemplary embodiment of the present invention, the second and third bends 113 and 114 may be combined into one sweeping arc. In an exemplary embodiment, the magnet core 106 is disposed between the third and fourth bends 114 and 115. Although the structure of the strap 111 has been described in detail along with the positioning of the magnet core 106 on the strap 111 for an exemplary embodiment, it should be noted that other exemplary embodiments include other positions of the magnet core 106.

In an exemplary embodiment, the thermal element 102 is a bimetallic element through which electrical current normally flows. However, it will be appreciated by one skilled in the art that the thermal element 102 may include other structures, such as, for example, a shape memory. A direction of a current flow through the thermal and magnetic trip unit 30 is shown by arrows 116. In this exemplary embodiment, each metal used in the thermal element 102 has a different coefficient of expansion. When current flows through the thermal element, a heat production occurs. The heat production causes the thermal element 102 to bend. If the current causes heat production that is sufficient, the thermal element 102 bends enough to move an associated trip latch, which unlatches an operating mechanism 16 (see FIGS. 1, 6 and 7) to separate the main current-carrying contacts 12 (see FIG. 1) thereby "tripping" or resulting in a "trip" of the circuit breaker. When the trip occurs, the current flow to the electrical load is interrupted. The thermal element 102 is used to trip the circuit breaker 10 for a predetermined level of an over current condition.

Figure 4:
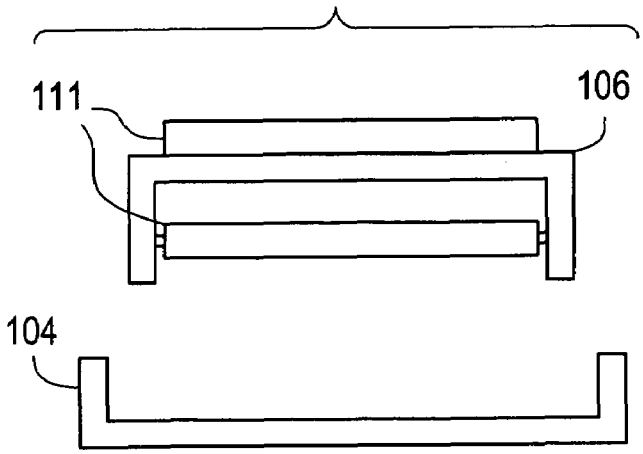
FIG. 4 is a side cut with background removed of the thermal and magnetic trip unit of FIG. 3.

FIG. 4 shows a view of a side cut through the thermal and magnetic trip unit 30. Magnet core 106 is disposed at the strap 111. The strap 111 passes through the magnet core 106. As the current through the strap 111 increases, the magnet core 106 produces an increased magnetic field. Arrow 116 shows generally the direction of current flow through the strap 111. The increased magnetic field causes an increased attraction between the magnet core 106 and the armature 104. FIG. 5 shows the magnetic field generated around the magnet core 106 in the side cut view of FIG. 4. Numerous magnetic flux lines 117 show the attraction between the magnet core 106 and the armature 104.

Figure 6:
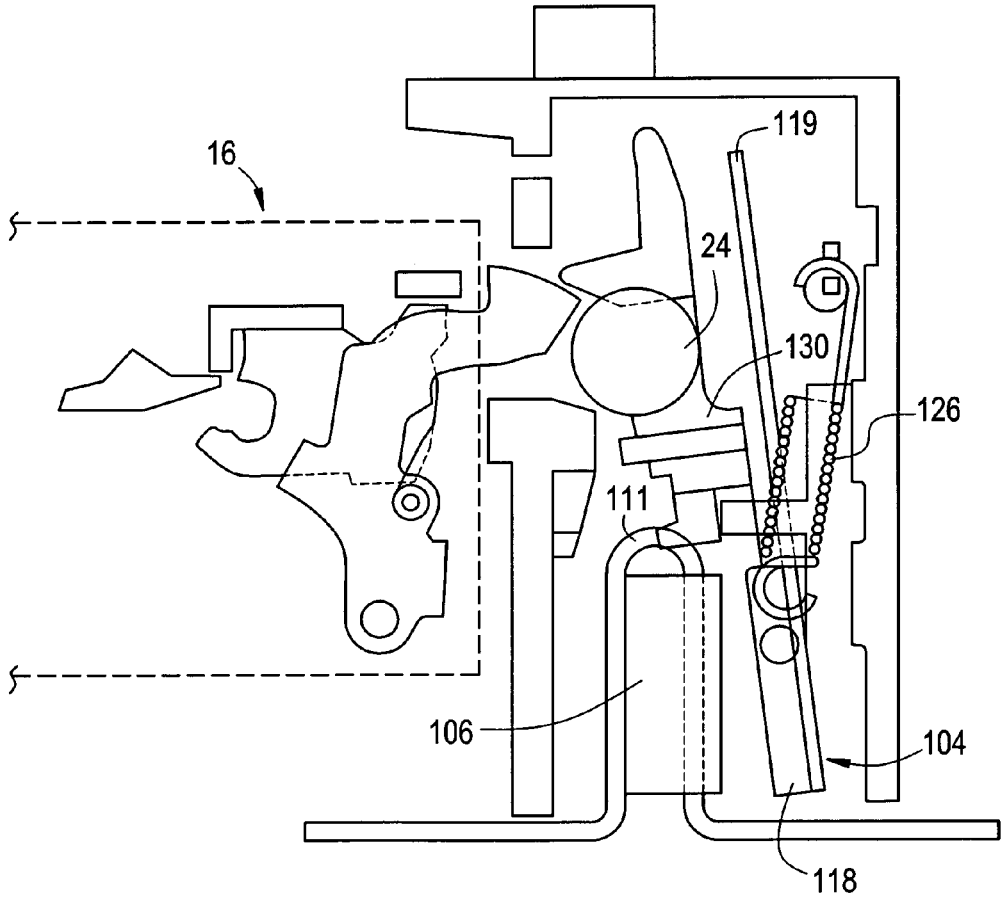
FIG. 6 is a cross section view of the thermal and magnetic trip unit in an ON position according to an exemplary embodiment.

FIG. 6 shows the thermal and magnetic trip unit 30 when the circuit breaker 10 is in an "ON" position. When the thermal and magnetic trip unit 30 is in the "ON" position, the main current-carrying contacts 12 (see FIG. 1) are closed allowing current to pass from input terminal 107 to the load terminal 108.

Figure 7:
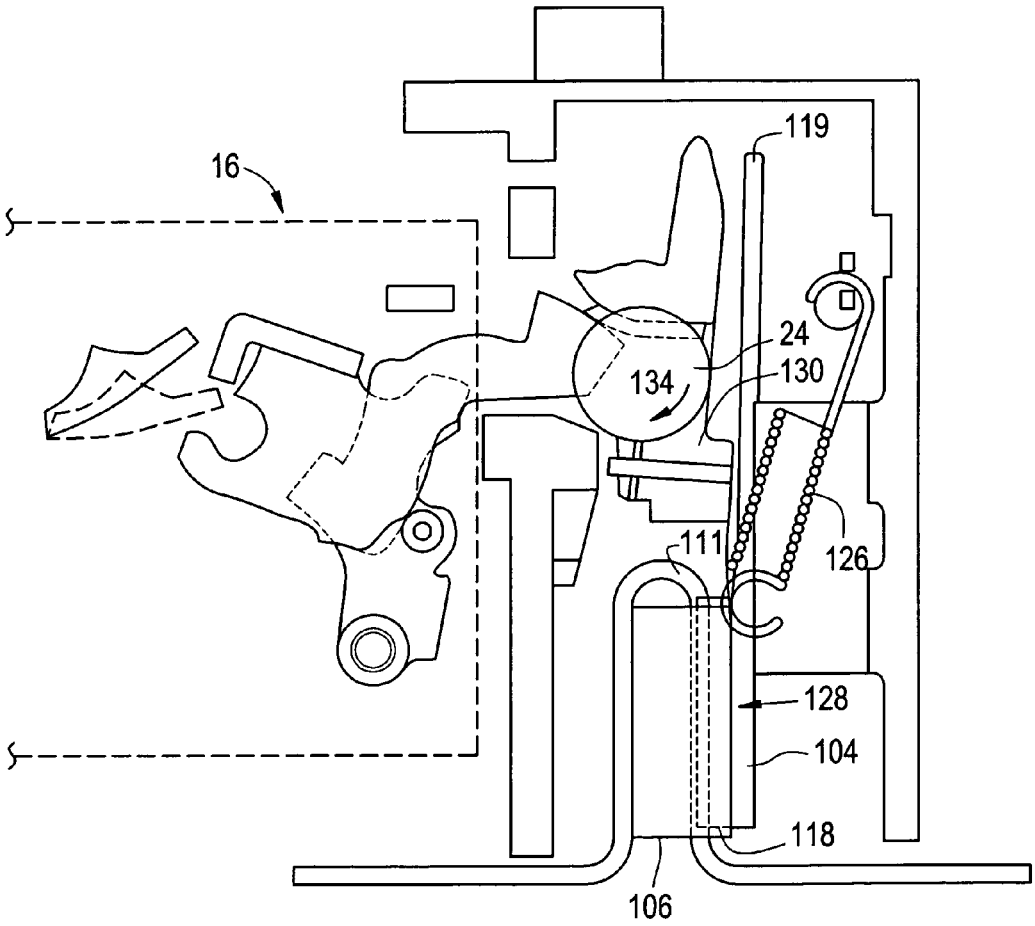
FIG. 7 is a cross section view of the thermal and magnetic trip unit in a tripped position according to an exemplary embodiment.

FIG. 7 shows the thermal and magnetic trip unit 30 when the circuit breaker 10 is in a "trip" condition. When the thermal and magnetic trip unit 30 is in the "trip" condition, the main current-carrying contacts 12 (see FIG. 1) are opened interrupting current flow to the electrical load.

Referring to FIGS. 6 and 7, armature 104 is a lever that has a first end 118 and a second end 119 opposite the first end 118. First end 118 is pivotally disposed near the magnet core 106. First end 118 is biased away from the magnetic core 106 by a biasing force from a spring 126. As the current through the strap 111 increases, the magnet core produces an increased magnetic field. The increased magnetic field causes an increased attraction between the magnet core 106 and the armature 104. The biasing force from the spring 126 is overcome when the magnetic field of the magnet core 106 reaches a predetermined level corresponding to a particular over current condition. When the biasing force of the spring 126 is overcome, the armature 104 pivots toward the magnet core 106. A direction of armature 104 motion is shown by arrow 128 in FIG. 7. When the armature 104 pivots toward the magnet core 106 the armature 104 moves a corresponding trip lever 130, which causes a rotation of a trip bar 24 in a direction shown by arrow 134. Rotation of the trip bar 24 is translated through the operating mechanism 16 to open the main current-carrying contacts 12 (see FIG. 1) thereby interrupting power to the electrical load (not shown). In other words, when the armature 104 pivots toward the magnet core 106, motion of the armature 104 causes the circuit breaker 10 to trip.

Figure 8:
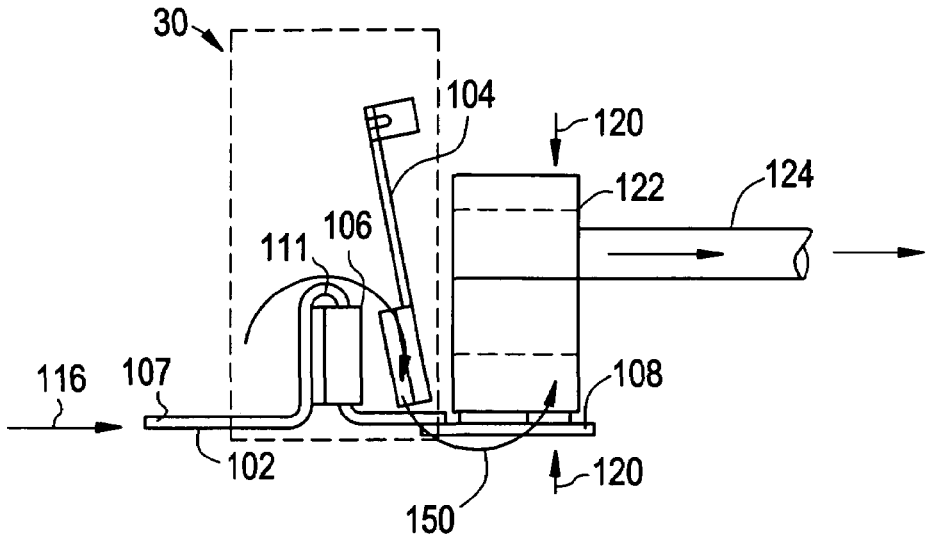
FIG. 8 is a schematic view of a thermal and magnetic trip unit assembly with a load terminal connected to a lug and cable according to an exemplary embodiment.

FIG. 8 shows an exemplary embodiment of the thermal magnetic trip unit 30 in which the same reference numerals will be used to refer to same or like parts as those described in FIG. 3. Further discussion of the operation of same or like parts will be omitted except where necessary. The thermal magnetic trip unit 30 comprises a plurality of components. The plurality of components includes the thermal element 102, the armature 104, the magnet core 106, and the load terminal 108 that is connected to a lug 122 and a cable 124. Lug 122 is secured to both the load terminal 108 and the cable 124 by fasteners (not shown), which each exert a force in diametrically opposed directions as shown by arrows 120. The lug 122 and the cable 124 carry electrical current from input terminal 107 to the electrical load (not shown), which may be downstream of the thermal and magnetic trip unit 30 when the main current-carrying contacts 12 (see FIG. 1) are closed. The direction of current flow through the thermal and magnetic trip unit 30 is shown by arrow 116.

Thermal element 102 includes the strap 111 to facilitate receiving the magnet core 106 as described above referring to FIG. 3. The thermal element 102, the armature 104, and the magnet core 106 operate as describe above with reference to FIGS. 3, 6 and 7.

Figure 9:
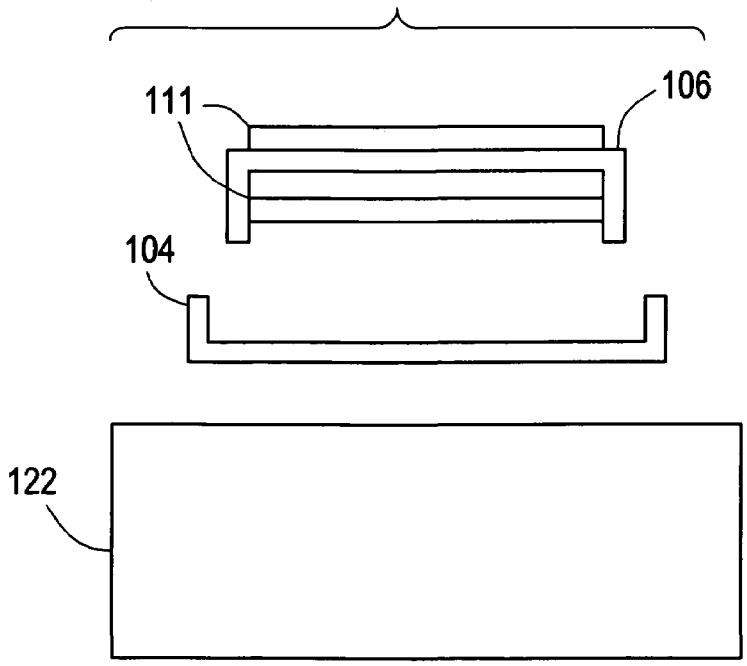
FIG. 9 is a side cut with background removed of the thermal and magnetic trip unit of FIG. 8.

FIG. 9 shows a side cut through the thermal and magnetic trip unit 30 shown in FIG. 8 with background removed.

Figure 10:
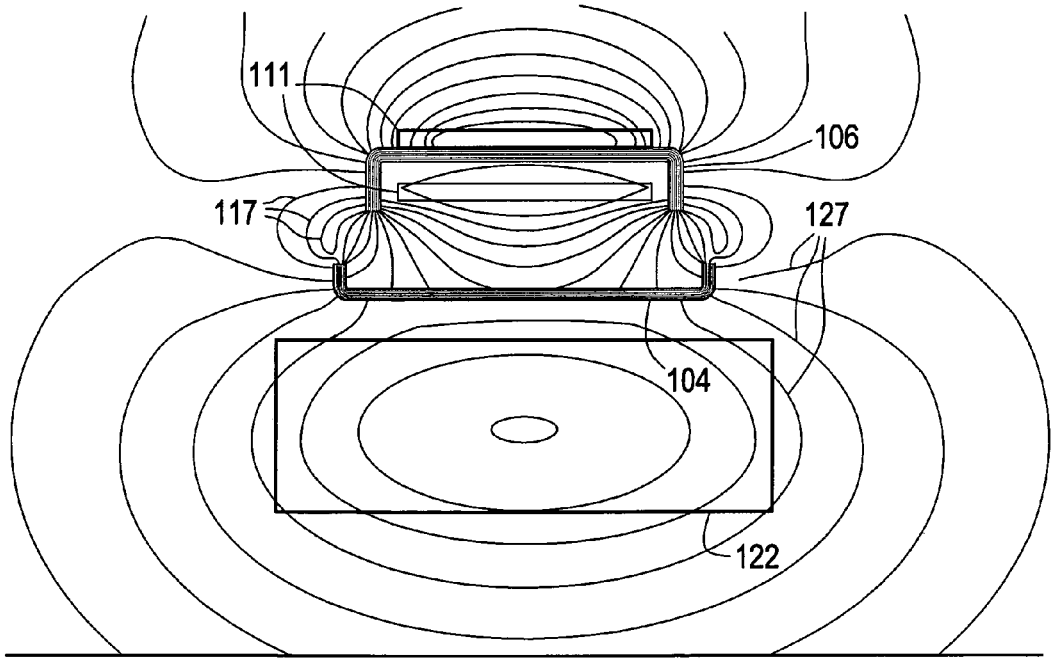
FIG. 10 shows magnetic lines of flux created when current passes through the thermal and magnetic trip unit of FIG. 9.

A reverse current, shown generally by arrow 150 creates a reverse current magnetic flux (see FIG. 8). The reverse current 150 is formed due to the flow of current through the lug 122. The reverse current 150 generates the reverse current magnetic flux by creating a magnetic field around the lug 122 as shown in FIG. 10. The reverse current magnetic flux may interfere with an operation of armature 104. As shown in FIG. 10, reverse current magnetic flux lines 127 provide an attraction to the armature 104 in an opposite direction to the direction of armature motion 128 (see FIG. 7) when a trip condition is sensed. The attraction of the reverse current magnetic flux lines 127 opposes the attraction of the magnetic flux lines 117. In other words, the reverse current magnetic flux causes a decrease in an armature force during the trip condition.

Figure 11:
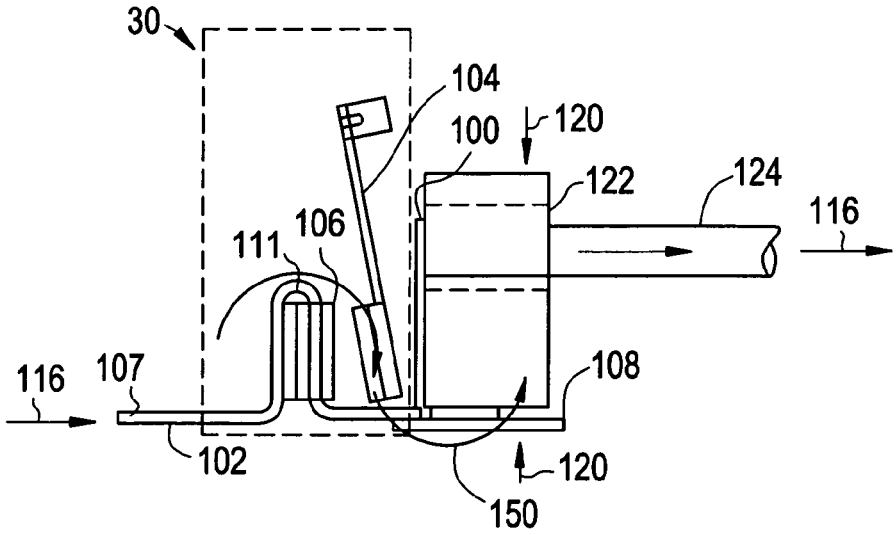
FIG. 11 is a schematic view of a thermal and magnetic trip unit assembly with a load terminal connected to the lug and cable with a shunt disposed between an armature and the lug according to an exemplary embodiment.

FIG. 11 shows an exemplary embodiment in which the same reference numerals will be used to refer to same or like parts as those described in FIGS. 3 and 8. Further discussion of the operation of same or like parts will be omitted except where necessary. FIG. 11 shows the thermal and magnetic trip unit 30 in which a magnetic barrier, referred to as the shunt 100, is added to the thermal and magnetic trip unit 30 of FIG. 8. Although in an exemplary embodiment, the shunt 100 is made of steel, use of other materials suitable for shielding is also envisioned such as, for example, low carbon steel. The thermal and magnetic trip unit 30 comprises a plurality of components. The plurality of components includes the thermal element 102, the armature 104, the magnet core 106, the shunt 100, and the load terminal 108 connected to the lug 122 and the cable 124. The plurality of components are disposed in order from the input terminal 107 to the load terminal 108 as follows: the input terminal 107, the thermal element 102, the strap 111, the magnet core 106, the armature 104, the shunt 100, and the load terminal 108. Though this exemplary embodiment has the plurality of components in the order listed above, it is envisioned that other arrangements are possible. Lug 122 is secured to both the load terminal 108 and the cable 124 by fasteners (not shown), which each exert the force in diametrically opposed directions as shown by arrows 120. The lug 122 and the cable 124 carry electrical current from input terminal 107 to the electrical load (not shown), which may be downstream of the thermal and magnetic trip unit 30 when the main current-carrying contacts 12 are closed. The direction of current flow through the thermal and magnetic trip unit 30 is shown by arrow 116.

Thermal element 102 includes the strap 111 to facilitate receiving the magnet core 106 as described above referring to FIG. 3. The thermal element 102, the armature 104, and the magnet core 106 operate as describe above with reference to FIGS. 3, 6 and 7.

Figure 12:
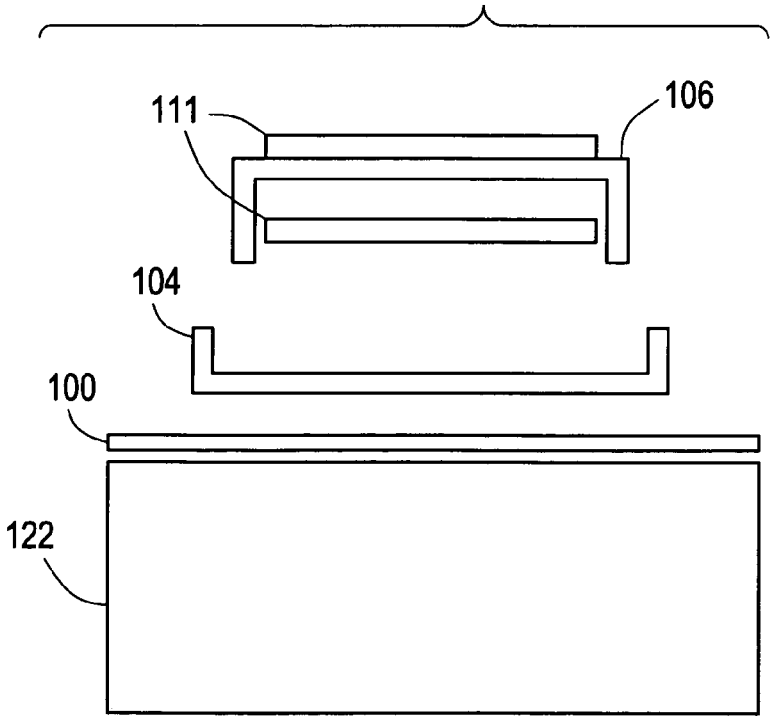
FIG. 12 is a side cut with background removed of the thermal and magnetic trip unit of FIG. 11.

FIG. 12 shows a side cut through the thermal and magnetic trip unit 30 shown in FIG. 11 with background removed.

Figure 13:
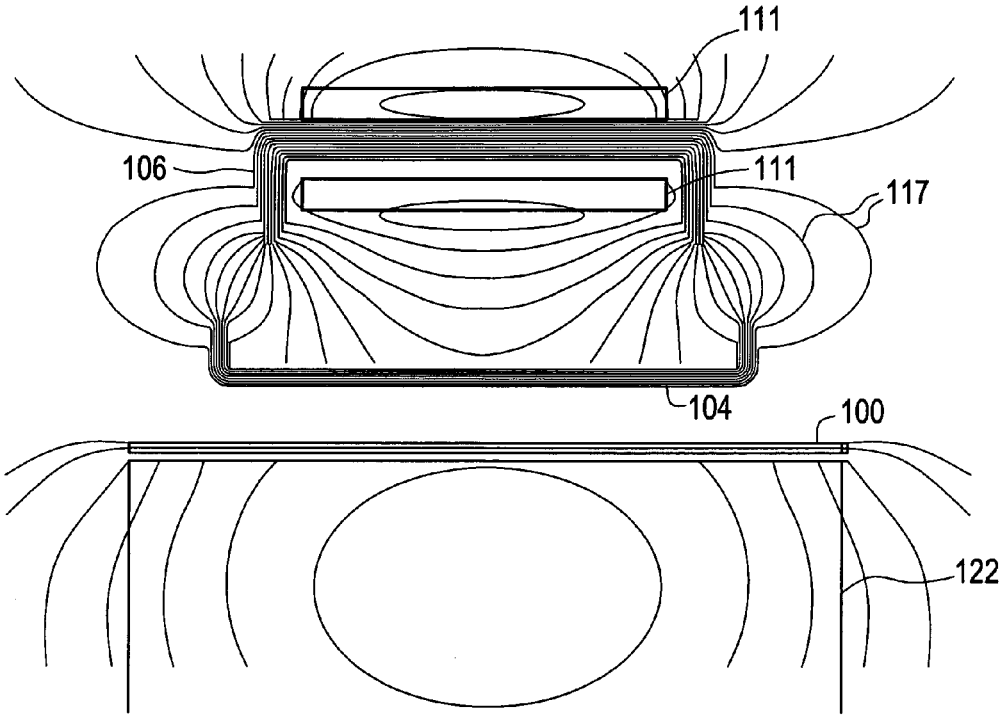
FIG. 13 shows magnetic lines of flux created when current passes through the thermal and magnetic trip unit of FIG. 12.

Referring to FIGS. 11, 12 and 13, the reverse current 150 is formed due to the flow of current 116 through the lug 122. The reverse current 150 generates the reverse current magnetic flux by creating the magnetic field around the lug 122. However, as shown in FIG. 13, the shunt 100 acts as a barrier to the magnetic field around the lug 122. The shunt 100 has been shown to reduce interference caused by the reverse current magnetic flux with the operation of the armature 104 when the trip condition is sensed. In other words, use of the shunt 100 prevents the decrease in the armature force when the trip condition is sensed. Thus, the shunt 100 acts as the magnetic barrier to shield the armature 104 and ensure efficient operation of the circuit breaker 10. It will be appreciated that although the exemplary embodiments described above involved a thermal and magnetic trip unit 30, the shunt 100 may be employed in any circuit breaker 10 having a magnetic trip unit, and also in switch-type circuit breakers having an instantaneously-only magnetic trip unit, that is, absent a thermal element.

In addition, while the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A trip unit for a circuit breaker having a current carrying conductor that electrically communicates with a cable or a bus bar, the trip unit comprising:

a current carrying strap adapted to be in electrical communication with the current carrying conductor;

a magnet core, said magnetic core disposed at said current carrying strap;

an armature, said armature pivotally disposed in magnetic communication with said magnet core; and a magnetic barrier disposed to shield said armature from a magnetic flux generated in the current carrying conductor, wherein said magnet barrier is disposed between the current carrying conductor and said armature, and said armature is disposed between said magnet barrier and said magnet core.

2. The trip unit of claim 1, wherein said magnetic barrier is disposed between the current carrying conductor and said armature, and said magnetic barrier is made of a low carbon steel.

3. The trip unit of claim 1, wherein the current carrying conductor includes a lug, said lug in mechanical and electrical communication with the cable.

4. The trip unit of claim 1, wherein said current carrying strap comprises a conduction path for a current through said magnet core.

5. The trip unit of claim 4, wherein said current carrying strap comprises:

a first portion of a conductive material disposed in a first direction;

a first bend of said conductive material defining a second portion in a second direction, said second direction being substantially perpendicular to said first direction;

a second bend of said conductive material defining a third portion in said first direction;

a third bend of said conductive material defining a fourth portion in a third direction, said third direction being substantially opposite to said second direction, said third direction being substantially perpendicular to said first direction; and a fourth bend of said conductive material defining a fifth portion in said first direction.

6. The trip unit of claim 5, wherein said magnet core is disposed proximate to said current carrying strap between said third bend and said fourth bend.

7. A cassette for a circuit breaker having a current carrying conductor that electrically communicates with a cable or a bus bar, the cassette comprising:

a housing;

a trip bar rotatably disposed at said housing;

a trip unit in mechanical communication with said trip bar, said trip unit comprising:

a current carrying strap adapted to be in electrical communication with the current carrying conductor;

a magnet core, said magnetic core disposed at said current carrying strap;

an armature, said armature pivotally disposed in magnetic communication with said magnet core; and a magnetic barrier disposed to shield said armature from a magnetic flux generated in the current carrying conductor, wherein said magnet barrier is disposed between the current carrying conductor and said armature, and said armature is disposed between said magnet barrier and said magnet core.

8. The cassette of claim 7, wherein said magnetic barrier is disposed between the current carrying conductor and said armature, and said magnetic barrier is made of a low carbon steel.

9. The cassette of claim 7, wherein the current carrying conductor includes a lug, said lug in mechanical and electrical communication with a cable.

10. The cassette of claim 7, wherein said current carrying strap comprises a conduction path for a current through said magnet core.

11. The cassette of claim 10, wherein said current carrying strap comprises:

a first portion of a conductive material disposed in a first direction;

a first bend of said conductive material defining a second portion in a second direction, said second direction being substantially perpendicular to said first direction;

a second bend of said conductive material defining a third portion in said first direction;

a third bend of said conductive material defining a fourth portion in a third direction, said third direction being substantially opposite to said second direction, said third direction being substantially perpendicular to said first direction; and a fourth bend of said conductive material defining a fifth portion in said first direction.

12. The cassette of claim 11, wherein said magnet core is disposed proximate to said current carrying strap between said third bend and said fourth bend.

13. A circuit breaker having a current carrying conductor that electrically communicates with a cable or a bus bar, the circuit breaker comprising:

a main contact assembly;

a mechanism for operating said main contact assembly; and a cassette in operable communication with said mechanism, said cassette comprising:

a housing; and a trip unit, said trip unit comprising:

a current carrying strap adapted to be in electrical communication with the current carrying conductor;

a magnet core, said magnetic core disposed at said current carrying strap;

an armature, said armature pivotally disposed in magnetic communication with said magnet core; and a magnetic barrier disposed to shield said armature from a magnetic flux generated in the current carrying conductor, wherein said magnet barrier is disposed between the current carrying conductor and said armature, and said armature is disposed between said magnet barrier and said magnet core.

14. The circuit breaker of claim 13, wherein said magnetic barrier is disposed between the current carrying conductor and said armature, and said magnetic barrier is made of a low carbon steel.

15. The circuit breaker of claim 13, wherein the current carrying conductor a lug, said lug in mechanical and electrical communication with a cable.

16. The circuit breaker of claim 13, wherein said current carrying strap comprises a conduction path for a current through said magnet core.

17. The circuit breaker of claim 16, wherein said current carrying strap comprises:

a first portion of a conductive material disposed in a first direction;

a first bend of said conductive material defining a second portion in a second direction, said second direction being substantially perpendicular to said first direction;

a second bend of said conductive material defining a third portion in said first direction;

a third bend of said conductive material defining a fourth portion in a third direction, said third direction being substantially opposite to said second direction, said third direction being substantially perpendicular to said first direction; and a fourth bend of said conductive material defining a fifth portion in said first direction.

18. The circuit breaker of claim 17, wherein said magnet core is disposed proximate to said current carrying strap between said third bend and said fourth bend.

19. A method for shielding an armature of a trip unit from a magnetic flux, the trip unit having a current carrying conductor and a current carrying strap electrically coupled with the current carrying conductor and a magnet core disposed at the current carrying strap, the magnetic flux produced by a current through the current carrying conductor, the method comprising:

disposing a magnetic barrier proximate to the armature with the magnetic barrier being disposed between the current carrying conductor and said armature and said armature being disposed between said magnet barrier and said magnet core; and responsive to a presence of the magnetic flux, redirecting the magnetic flux to shield the armature.

20. The method of claim 19, further comprising disposing said magnetic barrier between the armature and the current carrying conductor.

* * * * *